US008931867B2

(12) United States Patent
Kamiyama

(10) Patent No.: US 8,931,867 B2
(45) Date of Patent: Jan. 13, 2015

(54) PRINTING DEVICE, AND PRINTING DEVICE MAINTENANCE METHOD

(71) Applicant: Seiko Epson Corporation, Tokyo (JP)

(72) Inventor: Nobuaki Kamiyama, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 14/045,125

(22) Filed: Oct. 3, 2013

(65) Prior Publication Data

US 2014/0132653 A1 May 15, 2014

(30) Foreign Application Priority Data

Oct. 10, 2012 (JP) ..... 2012-225278

(51) Int. Cl.
*B41J 29/38* (2006.01)

(52) U.S. Cl.
USPC ..... 347/6; 347/7; 347/89

(58) Field of Classification Search
USPC ..... 347/7, 85, 86, 6, 14, 19, 89
See application file for complete search history.

(56) References Cited

U.S. PATENT DOCUMENTS

| | | | | |
|---|---|---|---|---|
| 7,597,434 | B2 * | 10/2009 | Nitta et al. | 347/89 |
| 8,366,224 | B2 * | 2/2013 | Yokota et al. | 347/7 |
| 2010/0134539 | A1 * | 6/2010 | Nitta et al. | 347/6 |
| 2013/0113852 | A1 | 5/2013 | Iwata | |
| 2013/0113854 | A1 | 5/2013 | Iwata | |

FOREIGN PATENT DOCUMENTS

| | | | |
|---|---|---|---|
| JP | 2002-038063 | A | 2/2002 |
| JP | 2013-071296 | A | 4/2013 |
| JP | 2013-099861 | A | 5/2013 |
| JP | 2013-099862 | A | 5/2013 |
| JP | 2013-129080 | A | 7/2013 |
| JP | 2013-129081 | A | 7/2013 |

* cited by examiner

*Primary Examiner* — Lam S Nguyen
(74) *Attorney, Agent, or Firm* — Global IP Counselors, LLP

(57) ABSTRACT

A printing device is equipped with a head, a first reservoir unit, a second reservoir unit, a first flow path connected to the head and the first reservoir unit, a second flow path connected to the first flow path and the second reservoir unit, a third flow path connected to the second reservoir unit and the second flow path, a first pressure supply unit provided on the second flow path, a second pressure supply unit, and a control unit for stirring the sedimentary ink by returning the sedimentary ink inside the second reservoir unit to the first reservoir unit using the second pressure supply unit after moving the sedimentary ink inside the first reservoir unit to the second reservoir unit using the first pressure supply unit.

3 Claims, 10 Drawing Sheets

PRINTING DEVICE, AND PRINTING DEVICE MAINTENANCE METHOD

CROSS-REFERENCE TO RELATED APPLICATIONS

This application claims priority to Japanese Patent Application No. 2012-225278 filed on Oct. 10, 2012. The entire disclosure of Japanese Patent Application No. 2012-225278 is hereby incorporated herein by reference.

BACKGROUND

1. Technical Field

The present invention relates to a printing device and a printing device maintenance method.

2. Related Art

Known as an example of a printing device is an inkjet printer (hereafter, "printer") which performs printing of images on a medium by discharging ink from nozzles provided on a head toward various types of media such as paper, film or the like. With the printer, ink is supplied to the head via a supply tube from an ink tank that stores ink.

Also, in recent years, in addition to cyan, magenta, and yellow colored inks as well as black ink, various colored inks have been used. For example, with a printer that uses white colored ink (see Japanese Laid-Open Patent Application Publication No. 2002-38063), it is possible to print a color image with good coloring properties by overlaying a white colored background image on a main image using color ink.

SUMMARY

However, when a so-called "sedimentary ink" for which the ink components like the coloring material and the like precipitate easily such as the white colored ink noted above are retained for a long time in the ink tank or the supply tube, the coloring material precipitates, the ink concentration becomes uneven, and the nozzles become clogged by coloring material that has precipitated and collected. In light of that, by circulating the sedimentary ink inside a closed flow path including the ink tank and the supply tube, it is possible to disperse the sedimentary ink components. However, there are cases when air (air bubbles) have penetrated the ink tank, and depending on the flow path constitution, the air remains in the supply tube during circulation of the sedimentary ink. When that happens, when ink is replenished to the head from the ink tank, air mixes in from the supply tube to inside the head, and it becomes impossible to properly discharge ink from the head.

The present invention was created considering that problem, and an object is to inhibit the mixing in of air when replenishing sedimentary ink to the head.

According to one aspect, a printing device is equipped with a head for discharging sedimentary ink, a first reservoir unit for storing the sedimentary ink, a second reservoir unit for storing the sedimentary ink from the first reservoir unit, a first flow path for which one end is connected to the head, and the other end is connected to the first reservoir unit, a second flow path for which one end is connected to the first flow path, and the other end is connected to the second reservoir unit, a third flow path for which one end is connected to the second reservoir unit, and the other end is connected to the second flow path, a first pressure supply unit provided on the second flow path, which sends the sedimentary ink in the direction for which the sedimentary ink is moved from the first reservoir unit to the second reservoir unit, a second pressure supply unit provided on the third flow path, which sends the sedimentary ink in the direction for which the sedimentary ink is moved from the second reservoir unit to the first reservoir unit, and a control unit for executing a stirring process of stirring the sedimentary ink by returning the sedimentary ink inside the second reservoir unit to the first reservoir unit using the second pressure supply unit after the sedimentary ink inside the first reservoir unit is moved to the second reservoir unit using the first pressure supply unit.

Other characteristics of the present invention will be made clearer by the notation of this specification and the attached drawings.

BRIEF DESCRIPTION OF THE DRAWINGS

Referring now to the attached drawings which form a part of this original disclosure.

DETAILED DESCRIPTION OF EXEMPLARY EMBODIMENTS

Figure 1:
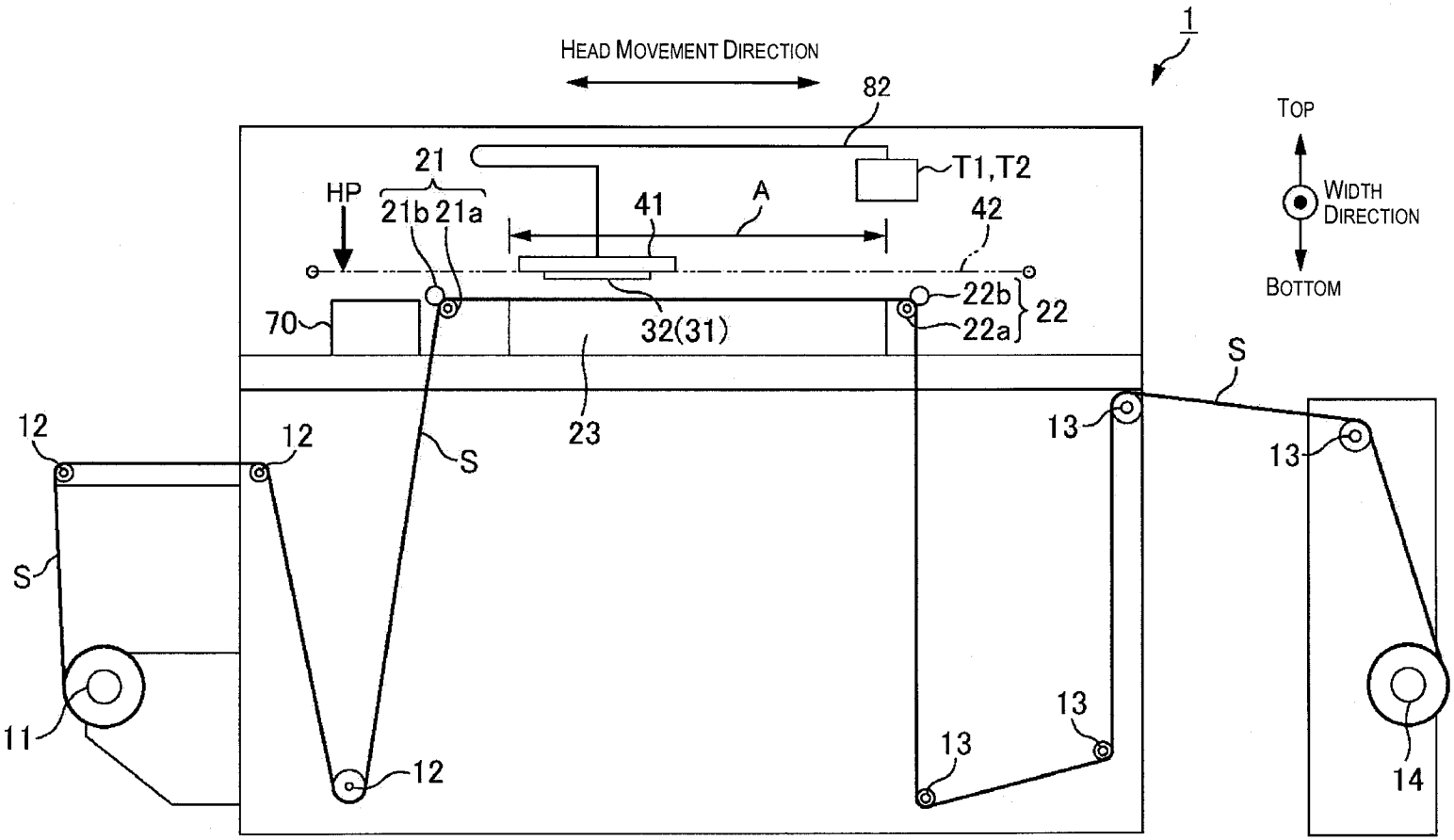
FIG. 1 is a schematic cross section view of the printer.

At least the following is made clear by the notation of this specification and the attached drawings.

A printing device is equipped with a head for discharging sedimentary ink, a first reservoir unit for storing the sedimentary ink, a second reservoir unit for storing the sedimentary ink from the first reservoir unit, a first flow path for which one end is connected to the head, and the other end is connected to the first reservoir unit, a second flow path for which one end is connected to the first flow path, and the other end is connected to the second reservoir unit, a third flow path for which one end is connected to the second reservoir unit, and the other end is connected to the second flow path, a first pressure supply unit provided on the second flow path, which sends the sedimentary ink in the direction for which the sedimentary ink is moved from the first reservoir unit to the second reservoir unit, a second pressure supply unit provided on the third flow path, which sends the sedimentary ink in the direction for which the sedimentary ink is moved from the second reservoir unit to the first reservoir unit, and a control unit for executing a stirring process of stirring the sedimentary ink by returning the sedimentary ink inside the second reservoir unit to the first reservoir unit using the second pressure supply unit after the sedimentary ink inside the first reservoir unit is moved to the second reservoir unit using the first pressure supply unit.

With this kind of printing device, it is possible to prevent air that was mixed into the first reservoir unit from remaining in the first flow path after executing the stirring process, and possible to inhibit the mixing in of air when replenishing sedimentary ink to the head. Also, simply by moving the sedimentary ink back and forth one time between the first reservoir unit and the second reservoir unit, it is possible to prevent air from remaining in the first flow path, so it is possible to make the stirring process time as short as possible.

With this printing device, at least one of the first pressure supply unit and the second pressure supply unit has a plurality of pumps.

With this kind of printing device, it is possible to further shorten the stirring process time.

Also, a printing device maintenance method is provided for a printing device equipped with a head for discharging sedimentary ink, a first reservoir unit for storing the sedimentary ink, a second reservoir unit for storing the sedimentary ink from the first reservoir unit, a first flow path for which one end is connected to the head and the other end is connected to the first reservoir unit, a second flow path for which one end is connected to the first flow path and the other end is connected to the second reservoir unit, and a third flow path for which one end is connected to the second reservoir unit and the other end is connected to the second flow path. The printing device maintenance method includes moving the sedimentary ink inside the first reservoir unit to the second reservoir unit using the first pressure supply unit provided in the second flow path, and using the second pressure supply unit provided in the third flow path, returning the sedimentary ink inside the second reservoir unit moved from the first reservoir unit to the first reservoir unit, and stirring the sedimentary ink.

With this kind of printing device maintenance method, it is possible to prevent the air that penetrated the first reservoir unit from remaining in the first flow path after executing the stirring process, and possible to inhibit mixing in of air when replenishing sedimentary ink to the head. Also, simply by moving the sedimentary ink back and forth once between the first reservoir unit and the second reservoir unit, it is possible to prevent air from remaining in the first flow path, so it is possible to make the stirring process time as short as possible.

Printing System

We will describe an embodiment with an example of an inkjet printer (hereafter, "printer") as the "printing device," showing an example of a printing system with the printer and a computer connected.

Figure 2A:
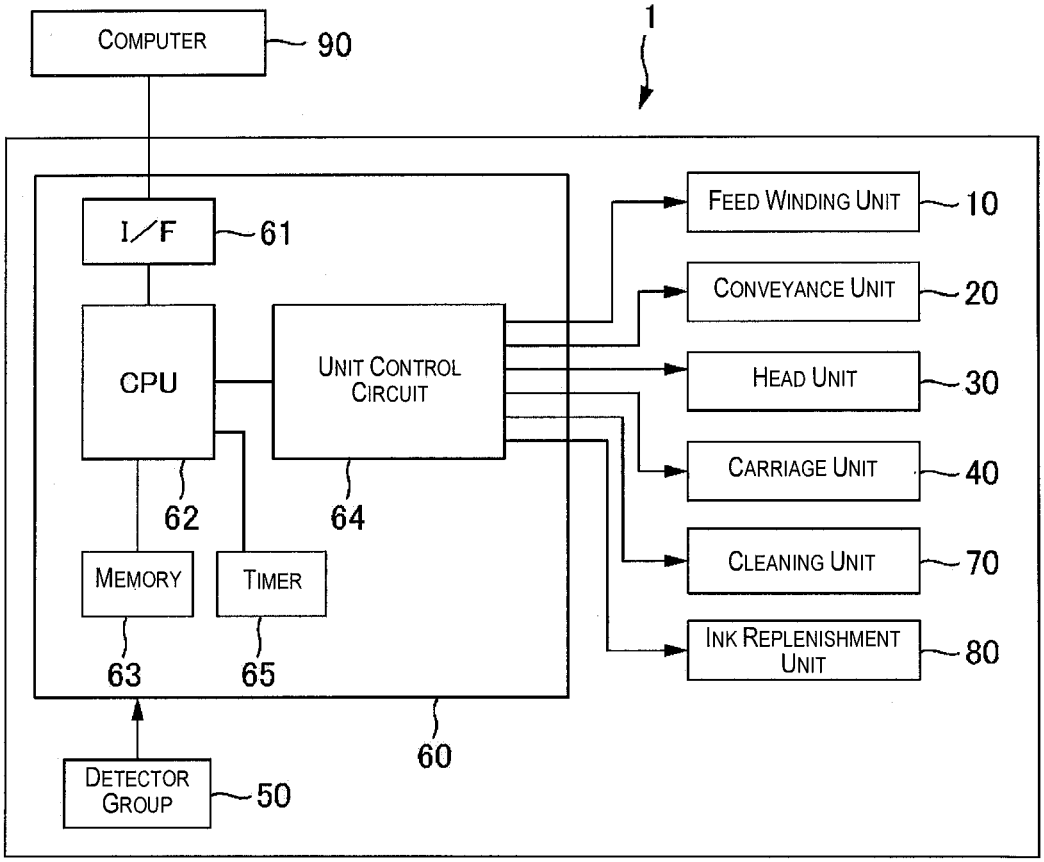
FIG. 2A is a block diagram showing the constitution of the printer.
Figure 2B:
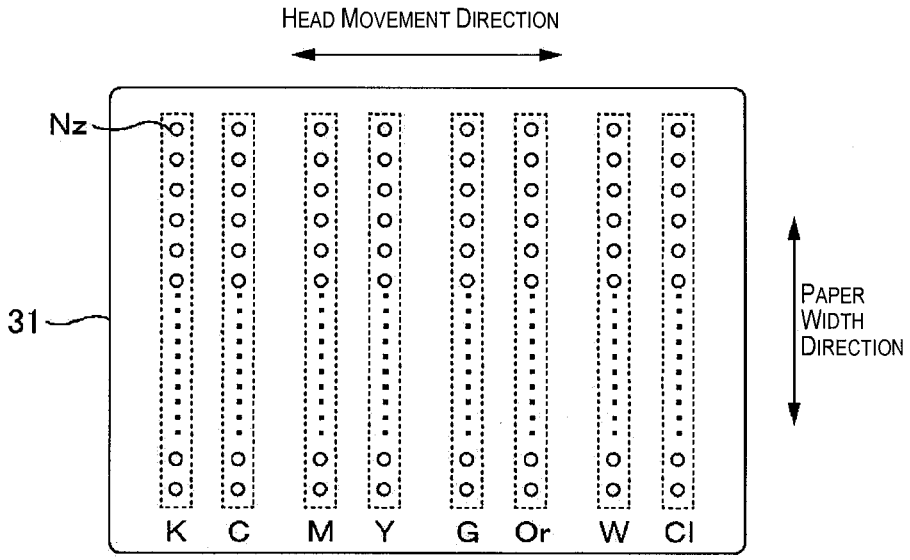
FIG. 2B is a drawing showing the nozzle array provided on the head.

FIG. 1 is a schematic cross section view of a printer 1. FIG. 2A is a block diagram showing the constitution of the printer 1, and FIG. 2B is a drawing showing an array of nozzles Nz provided on a head 31. The printer 1 has a feed winding unit 10, a conveyance unit 20, a head unit 30, a carriage unit 40, a detector group 50, a controller 60, a cleaning unit 70, and an ink replenishment unit 80. The printer 1 is connected to be able to communicate with the computer 90, and the data of the image to be printed by the printer 1 (print job) is sent from the computer 90 to the printer 1. With this embodiment, the medium (medium to be printed) for the printer 1 to print an image on is roll paper S (continuous forms), but this is not limited to that, and can also be a medium such as cut paper, plastic film, fabric or the like.

The controller 60 is an item for performing overall control of the printer 1. An interface unit 61 performs transfer of data with the computer 90 which is an external device. A CPU 62 is an arithmetic processing unit for performing overall control of the printer 1, and controls each unit via a unit control circuit 64. A memory 63 is an item for ensuring an area for storing the programs of the CPU 62, a work area and the like. A timer 65 is an item for counting the elapsed time from the previous stirring process, for example. The detector group 50 is an item that monitors the status inside the printer 1, and is for outputting the detection results to the controller 60.

The feed winding unit 10 has a winding shaft 11 with the roll paper S wound and supported to be able to rotate, an upstream relay roller 12 that winds up the roll paper S fed from the winding shaft 11 and conveys it, a downstream relay roller 13 that winds up the already printed roll paper S and conveys it, and a winding drive shaft 14 supported to be able to rotate that winds the roll paper S.

The conveyance unit 20 has a first conveyance roller 21 that feeds the roll paper S on the conveyance path to a printing area A, a second conveyance roller 22 that sends already printed roll paper S to the printing area A, and a platen 23 with the region of the roll paper S positioned in the printing area A supported from the opposite side (lower side) to the printing surface. The first conveyance roller 21 and the second conveyance roller 22 respectively have drive rollers 21*a* and 22*a* driven by a motor (not illustrated) and driven rollers 21*b* and 22*b* arranged so as to face opposite sandwiching the roll paper S in relation to the drive rollers 21*a* and 22*b*. During the period when an image is being printed on the region of the roll paper S on the printing area A, the conveyance of the roll paper S is temporarily stopped.

The head unit 30 has a plurality of heads 31 that discharge ink toward the region of the roll paper S positioned in the printing area A (on platen 23). As shown in FIG. 2B, a large number of nozzles (openings) Nz that discharge ink are provided on the bottom surface of the head 31, and nozzle rows are formed for each color of ink. The printer 1 of this embodiment can discharge eight colors of ink, and formed on the bottom surface of the head 31 (the nozzle opening surface) are nozzle row K for discharging black ink, nozzle row C for discharging cyan ink, nozzle row M for discharging magenta ink, nozzle row Y for discharging yellow ink, nozzle row G for discharging green ink, nozzle row Or for discharging orange ink, nozzle row W for discharging white ink, and nozzle row C1 for discharging clear ink. With each nozzle row, many nozzles Nz are aligned with a prescribed gap in the paper width direction of the roll paper S.

Figure 4:
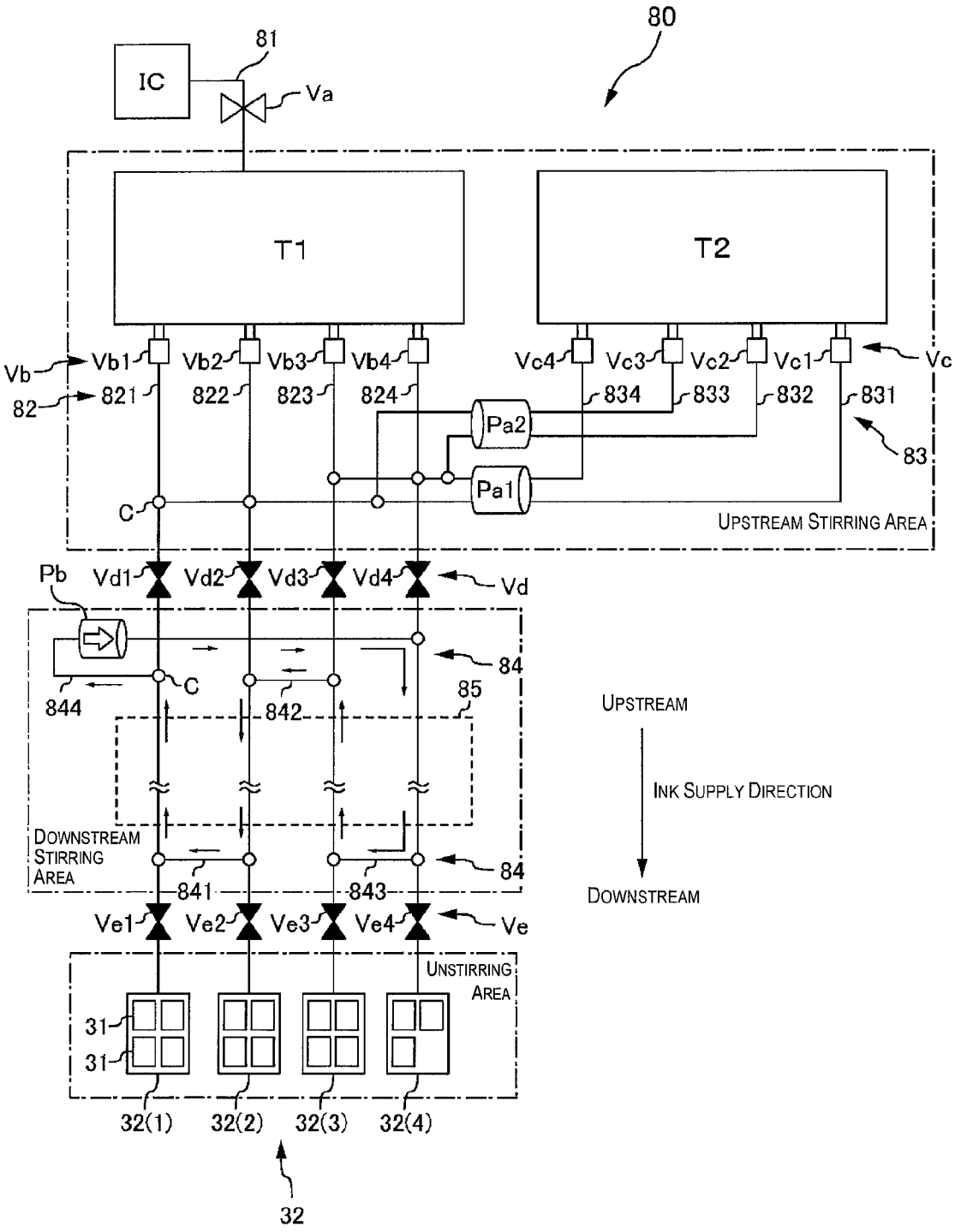
FIG. 4 is an explanatory drawing of the ink replenishment unit of white ink.

Also, the printer of this embodiment has fifteen heads 31, and the fifteen heads 31 are divided into groups of four head groups S32. In specific terms, as shown in FIG. 4 described later, four heads 31 respectively belong to each of a first head group 32 (1), a second head group 32 (2), and a third head group 32 (3), and three heads 31 belong to a fourth head group 32 (4).

The white ink correlates to the "sedimentary ink" for which the coloring material precipitates more easily than other color inks. As white ink, examples include ink containing a white colored pigment such as titanium oxide or the like, or ink containing a hollow polymer. By printing a color image or monochromatic image overlapping on a white colored background image using white ink, it is possible to print an image with good coloring properties not affected by other colors of the medium. Also, clear ink is colorless, transparent ink. By coating a color image or monochromatic image with clear ink, it is possible to improve the image glossiness and weather resistance.

A carriage unit 40 is an item for moving the head group 32 placed on a carriage 41. The head group 32 can be moved by the carriage 31 in the conveyance direction (head movement direction shown in FIG. 1) of the roll paper S positioned in printing area A, and can also be moved in the paper width direction that is the orthogonal direction to that. The carriage 41 is divided into four sub-carriages, and one head group 32 is placed on one sub-carriage.

A cleaning unit 70 is an item for testing for ink discharge failure from the nozzles Nz, and cleaning the head 31, and is set at a home position HP (details described later).

The ink replenishing unit 80 is an item for replenishing (supplying) ink to the head 31 when ink is discharged from the head 31 and the ink volume inside the head 31 has decreased (details described later).

With the printer 1 with this kind of constitution, by having the head group 32 discharge ink while it moves in the head movement direction in relation to the region of the roll paper S positioned in the printing area A and also move in the paper width direction, the operation of printing a two dimensional image on the roll paper S and the operation of feeding the region of the already printed roll paper S from the printing area A and conveying the region of the roll paper S before printing to the printing area A are alternately repeated, and an image is continuously printed on the roll paper S. Because of that, the roll paper S is intermittently conveyed by area units corresponding to the printing area A, and images are printed. With the description below, a one time printing of the area unit corresponding to the printing area A is also called one page of printing.

Cleaning Unit 70

Figure 3:
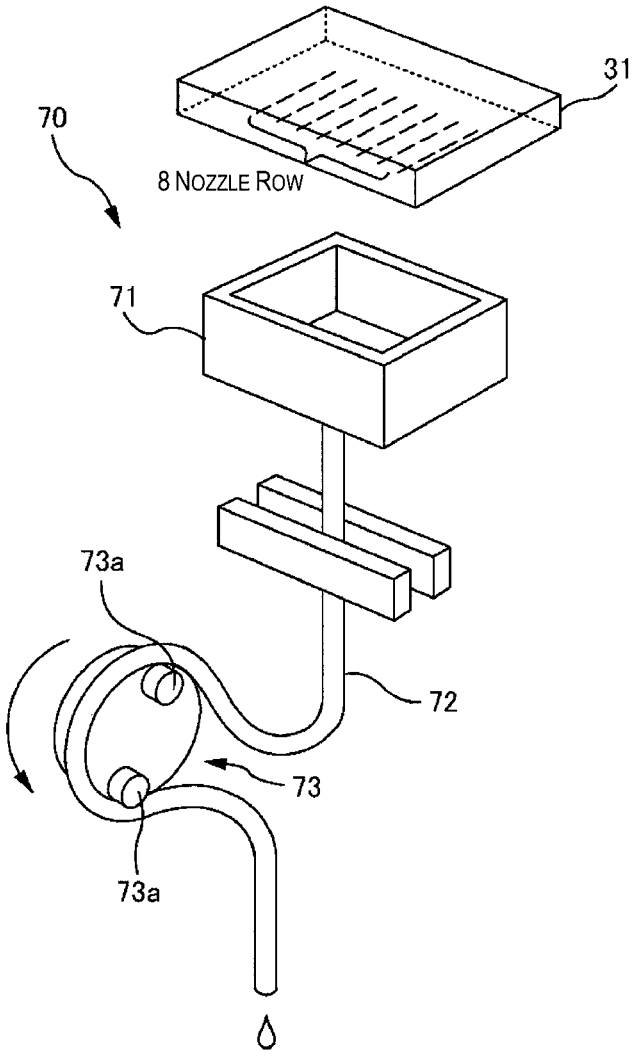
FIG. 3 is an explanatory drawing of a cleaning unit.

FIG. 3 is an explanatory drawing of the cleaning unit 70. When a period continues for which ink is not discharged from the nozzle Nz, there is a risk that the ink will thicken due to evaporation of the ink solvent from the nozzle Nz, or that air bubbles will mix inside the nozzle Nz. If that is the case, discharge failure may occur, such as that a suitable volume of ink may not be discharged from the nozzle Nz, or the ink drops may not land on the correct position. In light of that, the cleaning unit 70 retracts the head group 32 to the home position HP, and executes "defective nozzle testing" that detects a defective nozzle for which discharge failure has occurred, and the "cleaning process" of the head 31 to restore the defective nozzle to a normal nozzle. For that, for each head 31, the head unit 70 has a cap 71, an eject tube 72 connected to the bottom part of the cap 71, a suction pump 73 provided midway in the eject tube 72, and a defective nozzle testing unit (not illustrated). To make the explanation simpler with FIG. 3, the cleaning unit 70 corresponding to one head 31 is shown, but in actuality, each member is provided with fifteen each.

Using the defective nozzle testing unit, the controller 60 performs defective nozzle detection periodically on the fifteen heads 31 or the heads 31 used for printing. The defective nozzle testing is performed in a state with the head 31 facing opposite with a gap toward the cap 71. As the defective nozzle testing method, for example, there is a method of discharging ink drops toward the cap 71 from the nozzle Nz so as to have the ink drops pass through between a light source and an optical sensor, and to detect defective nozzles based on whether or not the light is blocked by the ink drops. Another example is a method by which, in a state with the bottom surface of the head 31 (nozzle opening surface) which is at ground potential and a high electric potential detection electrode provided on the bottom of the cap 71 having a prescribed gap open, electrically conductive ink from the nozzle Nz is discharged toward the detection electrode, and defective nozzles are detected based on the electrical changes that occur with the detection electrode due to the ink discharge from the nozzle Nz. However, the invention is not limited to these methods.

Then, as a result of the defective nozzle testing, when a defective nozzle is detected, the controller 60 executes the head 31 cleaning process. It is also possible to periodically execute the cleaning process, rather than only when a defective nozzle is detected. The head 31 cleaning process is performed in a state with the cap 71 adhered to the bottom surface of the head 31. As shown in FIG. 3, the cap 71 is a box shaped member with the top part open, and when the cap 71 is adhered to the bottom surface of the head 31 (nozzle opening surface), all eight nozzle rows provided on the head 31 are covered by the cap 71, forming an airtight space that is not in communication with the air. In that state, when the suction pump 73 is driven, the airtight space between the head 31 and the suction pump 73 goes to negative pressure, foreign matter (thickened ink, paper dust, air bubbles and the like) are suctioned together with ink from the nozzles Nz of the head 31, and it is possible to restore the defective nozzle to a normal nozzle.

The suction pump 73 has two small rollers 73*a* near its circumference edge part, and the eject tube 72 is wound in the periphery of these two small rollers 73*a*. Then, when the suction pump 73 is driven and rotates in the arrow direction, the air inside the eject tube 72 is pressed by the small rollers 73*a*, the airtight space between the head 31 and the cap 71 goes to negative pressure, and the ink and foreign matter are suctioned from the nozzles Nz.

Also, for example, when ink is not discharged from the head 31 over a relatively long time such as when the printer 1 power is off, during waiting for a print job or the like, it is also possible to move the head group 32 to the home position HP, to adhere the cap 71 to each head 31, and to seal the nozzles Nz. By doing that, it is possible to inhibit evaporation of ink from the nozzle Nz and mixing in of foreign matter.

Also, with this embodiment, during defective nozzle testing, during the head 31 cleaning process, and during the flushing operation, ink is discharged from the nozzle Nz toward the same cap 71, but the invention is not limited to this. For example, separate from the cap 71 used with the cleaning process, it is also possible to provide a separate flushing box which receives ink discharged from the nozzle Nz with the flushing operation. Also, it is possible to seal the nozzle rows provided on a plurality of heads 31 using one cap.

Ink Replenishment Unit 80

FIG. 4 is an explanatory drawing of the ink replenishment unit 80 for white ink. The ink replenishment unit 80 is an item for replenishing ink to the head 31, and is provided for each color of ink. Here, a detailed description of the ink replenishment unit 80 for white ink (sedimentary ink) is given. As shown in FIG. 4, the ink replenishment unit 80 for white ink (hereafter, also simply called ink replenishment unit) has a cartridge IC for storing white ink, a sub tank T1, a temporary tank T2, an upstream tube 81, four supply tubes 82 (821 to 824), four branch tubes 83 (831 to 834), a cartridge valve Va, four sub tank valves Vb (Vb1 to Vb4), four temporary tank valves Vc (Vc1 to Vc4), four intermediate valves Vd (Vd1 to Vd4), four head side valves Ve (Ve1 to Ve4), a first upstream pump Pa1, a second upstream pump Pa2, and a downstream pump Pb. Each tube becomes a white ink flow path (passage), and each valve opens or closes the flow of white ink.

The cartridge IC is an item for storing white ink, and is constituted to be able to be attached and detached with the printer 1 main unit. The sub tank T1 is an item for storing the white ink supplied from the cartridge IC before it is supplied to the head group 32, and is constituted so as to be fixed on the printer 1 interior, and to be able to be attached and detached from the printer 1 main unit. The temporary tank T2 is an item for temporarily storing white ink supplied from the sub tank T1.

The cartridge IC and the sub tank T1 are in communication via the upstream tube 81, and the cartridge valve Va is provided midway in the upstream tube 81. Also, provided in the sub tank T1 is a sensor (not illustrated) that detects when the ink volume inside the tank is less than a threshold value. When the controller 60 receives a signal from that sensor, it opens the cartridge valve Va that was closed, and has white ink flow into the sub tank T1 from the cartridge IC. Because of that, white ink of a volume of the threshold value or greater is always stored in the sub tank T1.

Four supply tubes 821 to 824 are connected to the sub tank T1, and the sub tank T1 is in communication respectively with the four head groups 32 (1) to 32 (4) via one supply tube 82. For example, the sub tank T1 and the first head group 32 (1) are in communication via the first supply tube 821, and the sub tank T1 and the second head group 32 (2) are in communication via the second supply tube 822. Then, when the white ink inside the head 31 is consumed, the white ink flows into the inside of the head 31 through the supply tubes 82 from the sub tank T1.

The temporary tank T2 is in communication with the sub tank T1 via the four supply tubes 821 to 824 connected to the sub tank T1, the first branch tube 831 branched from the first and second supply tubes 821 and 822, the third branch tube 833 branched from that first branch tube 831, the fourth branch tube 834 branched from the third and fourth supply tubes 823 and 824, and the second branch tube 832 branched from that fourth branch tube 834. Each tube is in communication by connecting with another tube via a connector C.

Also, the four supply tubes 821 to 824 are respectively connected to the sub tank T1 via the sub tank valves Vb1 to Vb4, and the four branch tubes 831 to 834 are respectively connected to the temporary tank T2 via the temporary valves Vc1 to Vc4.

Then, the first upstream pump Pa1 is provided midway in the first and fourth branch tubes 831 and 834, and the second upstream pump Pa2 is provided midway in the second and third branch tubes 832 and 833. The first upstream pump Pa1 sends ink in the direction moving ink from the sub tank T1 to the temporary tank T2, and the second upstream pump Pa2 sends ink in the direction moving the ink from the temporary tank T2 to the sub tank T1.

The sub tank T1 and the temporary tank T2 have flexibility, are formed in a bag shape using polyethylene resin, for example, or are formed in a bag shape using another resin having flexibility, or a metal such as silicon, aluminum or the like. Because of that, the sub tank T1 and the temporary tank T2 bend according to the housed ink volume, expand in accordance with ink filling the interior, contract in accordance with ink flowing out to the outside and the like, and can be flexibly deformed while keeping a certain amount of rigidity. Therefore, it is possible to deform until the state when the sub tank T1 and the temporary tank T2 are crushed with suction using the pump, and to flow out all of the white ink and air inside the sub tank T1 and the temporary tank T2.

Also, the bypass tubes 84 are connected by the connectors C to the supply tubes 82 at a position further downstream in the ink supply direction than the connecting part of the supply tubes 82 and the branch tubes 83. The four bypass tubes 841 to 844 are placed across mutually different supply tubes 82. In specific terms, the second supply tube 822 is connected to (in communication with) the first supply tube 821 via the first bypass tube 841, the third supply tube 823 is connected to (in communication with) the second supply tube 822 via the second bypass tube 842, the fourth supply tube 824 is connected to (in communication with) the third supply tube 823 via the third bypass tube 843, and the first supply tube 821 is connected to (in communication with) the fourth supply tube 824 via the fourth bypass tube 844.

The second bypass tube 842 and the fourth bypass tube 844 are provided at positions nearer to the sub tank T1 than the head group 32, and the first bypass tube 841 and the third bypass tube 843 are provided at positions nearer to the head group 32 than the sub tank T1. Also, because the sub tank T1 and the head group 32 are arranged at separated positions, the four supply tubes 821 to 824 become long tubes. Because of that, the supply tubes 821 to 824 between the second and fourth bypass tubes 842 and 844 and the first and third bypass tubes 841 and 843 are housed inside a Cableveyor (registered trademark) 85.

Then, the downstream pump Pb that feeds the ink inside the first supply tube 821 to the fourth supply tube 824 is provided midway in the fourth bypass tube 844. Also, interim valves Vd1 to Vd4 are provided at positions further downstream in the ink supply direction than the connecting part of the supply tube 82 and the branch tube 83, being midway in each of the supply tubes 821 to 824, and at positions further upstream than the connecting part of the supply tube 82 and the bypass tube 84. Also, head side valves Ve1 to Ve4 are provided at positions further upstream than the head group 32, being midway in each of the supply tubes 821 to 824, and positions further downstream in the ink supply direction than the connecting part of the supply tubes 82 and the bypass tubes 84.

The description above is the constitution of the ink replenishment unit 80 of the white ink. Since other colored inks are not sedimentary inks, the ink replenishment unit 80 of the other colored inks has a typical constitution that does not have the temporary tank T2, the branch tubes 83, the bypass tubes 84, the pumps Pa1, Pa2, Pb and the like. With the ink replenishment unit 80 of FIG. 4, the sub tank T1 is provided between the cartridge IC and the head group 32, but the invention is not limited to this, and for example, it is also possible to constitute it so that ink is replenished directly from the cartridge IC to the head group 32. Also, with the ink replenishment unit 80 in FIG. 4, ink is replenished from one supply tube 82 to one head group 32, and four supply tubes 82 are connected to the one head group 32, but the invention is not limited to this, and for example, it is also possible to constitute it such that the sub tank T1 and the head group 32 are connected by one or two supply tubes 82.

Stirring Process

The white ink used with the printer 1 of this embodiment is "sedimentary ink" for which the coloring material precipitates more easily than other color inks. Because of that, when the white ink is retained over a long period inside the tank in which the ink is stored, or the tube and the head 31 that are the flow path of the ink, the coloring material of the white ink precipitates. When that happens, the white ink concentration becomes uneven, and the nozzles Nz become clogged by the precipitated and collected coloring material. As a result, the image quality of the printed image is degraded. In light of that, with the printer 1 of this embodiment, by stirring the white ink inside the ink replenishment unit 80, the white ink coloring material sedimentation is eliminated (coloring material is dispersed), and printer 1 maintenance is performed.

In specific terms, as shown in FIG. 4, there is a division into an "upstream stirring area" which is a closed flow path formed by closing the cartridge valve Va and the intermediate valve Vd, and a "downstream stirring area" which is a closed flow path formed by closing the intermediate valve Vd and the head side valve Ve, and the white ink stirring process is executed. Following, the stirring process of each area will be described.

Downstream Stirring Area

In the normal time other than during the stirring process (e.g. during the printing operation or the like), the intermediate valve Vd and the head side valve Ve are open, and the downstream pump Pb is stopped. Because of that, when executing the stirring process in the downstream stirring area, the controller 60 closes the four intermediate valves Vd1 to Vd4 and the four head side valves Ve1 to Ve4. As a result, as shown in FIG. 4, closed flow paths (circulation paths) are formed constituted by the four supply tubes 821 to 824 (a portion) and the four bypass tubes 841 to 844.

Then, when the controller 60 drives the downstream pump Pb, the white ink is circulated inside the closed flow path in the direction in which the white ink inside the first supply tube 821 flows via the fourth bypass tube 844 to the fourth supply tube 824. As a result, the white ink that exists inside the supply tube 82 and the bypass tube 84 between the intermediate valve Vd and the head side valve Ve is stirred, and it is possible to eliminate the white ink coloring material sedimentation.

In this way, by having the four bypass tubes 841 to 844 extended between mutually different supply tubes 821 to 824, it is possible to circulate the white ink respectively retained inside the four supply tubes 821 to 824 using one downstream pump Pb.

Upstream Stirring Area: Comparison Example

Here, the stirring process in the upstream stirring area of a comparison example before describing the stirring process of the upstream stirring area of this embodiment will be described.

FIG. 5A through FIG. 5F are explanatory drawings of the stirring process in the upstream stirring area of a comparison example. With the upstream stirring area of the comparison example (FIG. 5A), in contrast to the upstream stirring area of this embodiment (FIG. 4), four branch tubes 831' to 834' are respectively connected to the four supply tubes 821 to 824 connected to the sub tank T1, the first upstream pump Pa1 is provided midway in the first and fourth branch tubes 831' and 834', and the second upstream pump Pa2 is provided midway in the second and third branch tubes 832' and 833'.

In the normal times other than during the stirring process (e.g. during the printing operation or the like), the intermediate valve Vd is open, and the first upstream pump Pa1 and the second upstream pump Pa2 are stopped. Because of that, first, if the cartridge valve Va is opened, the controller 60 closes it, and closes the four intermediate valves Vd1 to Vd4. Having done that, as shown in FIG. 5A, a closed flow path constituted by the upstream tube 81 (one portion), the sub tank T1, the temporary tank T2, the four supply tubes 821 to 824 (one portion), and the four branch tubes 831' to 834' is formed.

However, when white ink is retained over a long period inside the cartridge IC, the white ink coloring material precipitates. However, the cartridge IC is constituted to be able to be attached and detached with the printer 1 main unit. Because of that, by the user removing the cartridge IC from the printer 1 and shaking it up and down, the white ink inside the cartridge IC is stirred, and it is possible to eliminate the white ink coloring material sedimentation. However, after stirring the white ink inside the cartridge IC, when the user mounts the cartridge IC in the printer 1, there are cases when air (air bubbles) penetrate into the sub tank T1 from the cartridge IC. In light of that, hereafter, an example of when together with the ink, air mixes into the sub tank T1 (e.g. when 95 cc of ink and 5 cc of air are mixed in) will be described. The state is without ink or air housed (hollow state) in the temporary tank T2, and the state is with ink filled in the supply tubes 82 and the branch tubes 83.

Figure 5A:
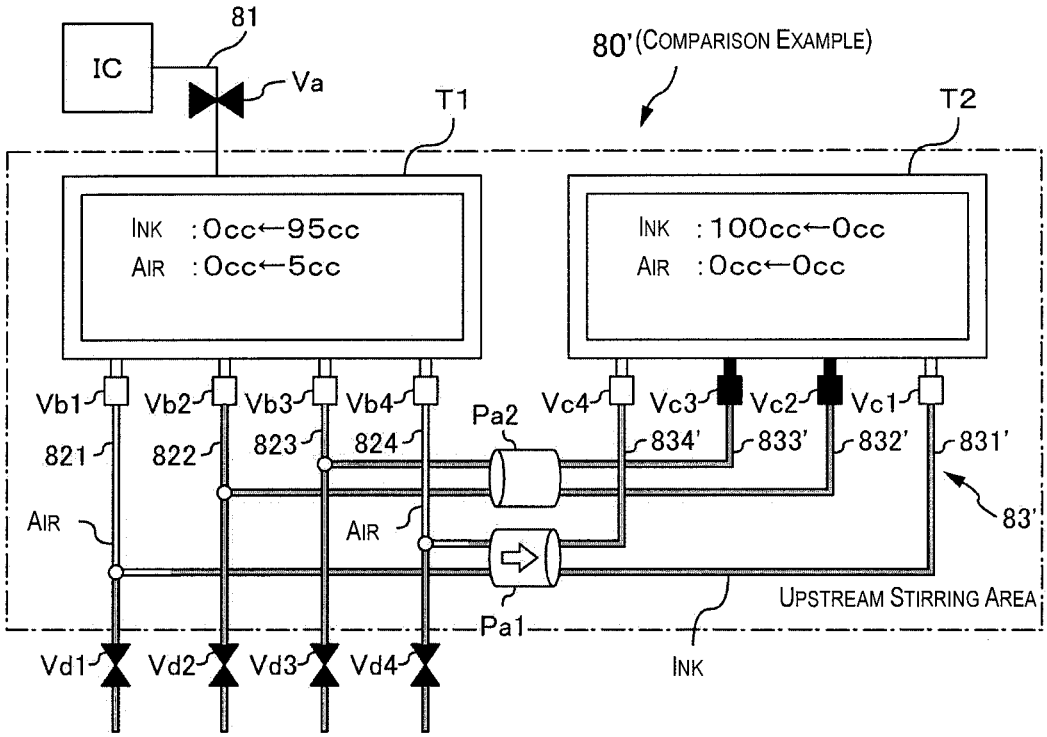
FIG. 5A is an explanatory drawing of the stirring process with the upstream stirring area of a comparison example.

First, as shown in FIG. 5A, in a state with the cartridge valve Va and the intermediate valve Vd closed, the controller 60 sets a state whereby the second and third temporary tank valves Vc2 and Vc3 are closed, and the first and fourth temporary valves Vc1 and Vc4 and the sub tank valves Vb1 to Vb4 are open. Then, the controller 60 drives only the first upstream pump Pa1, and moves white ink from the sub tank T1 to the temporary tank T2. At this time, the white ink flows from the sub tank T1 to the temporary tank T2 through the region of the first supply tube 821 between from the connecting part of the first supply tube 821 and the first branch tube 831' to the first sub tank valve Vb1, the first branch tube 831', the region of the fourth supply tube 824 between from the connecting part of the fourth supply tube 824 and the fourth branch tube 834' to the fourth sub tank valve Vb4, and the fourth branch tube 834' (hereafter collectively referred to as the "outward path").

Also, at this time, the controller 60 drives the first upstream pump Pa1 until the sub tank T1 reaches a crushed state, and all the air is flowed out after all the ink has been flowed out from the sub tank T1. As a result, the sub tank T1 is in a hollow state (both ink and air are 0 cc), the temporary tank T2 is filled with ink filled in the outward path (e.g. 10 cc) and ink flowed out from the sub tank T1 (e.g. 90 cc), and the outward path is filled with the ink (e.g. 5 cc) and air (e.g. 5 cc) that finally flowed out from the sub tank T1.

Figure 5B:
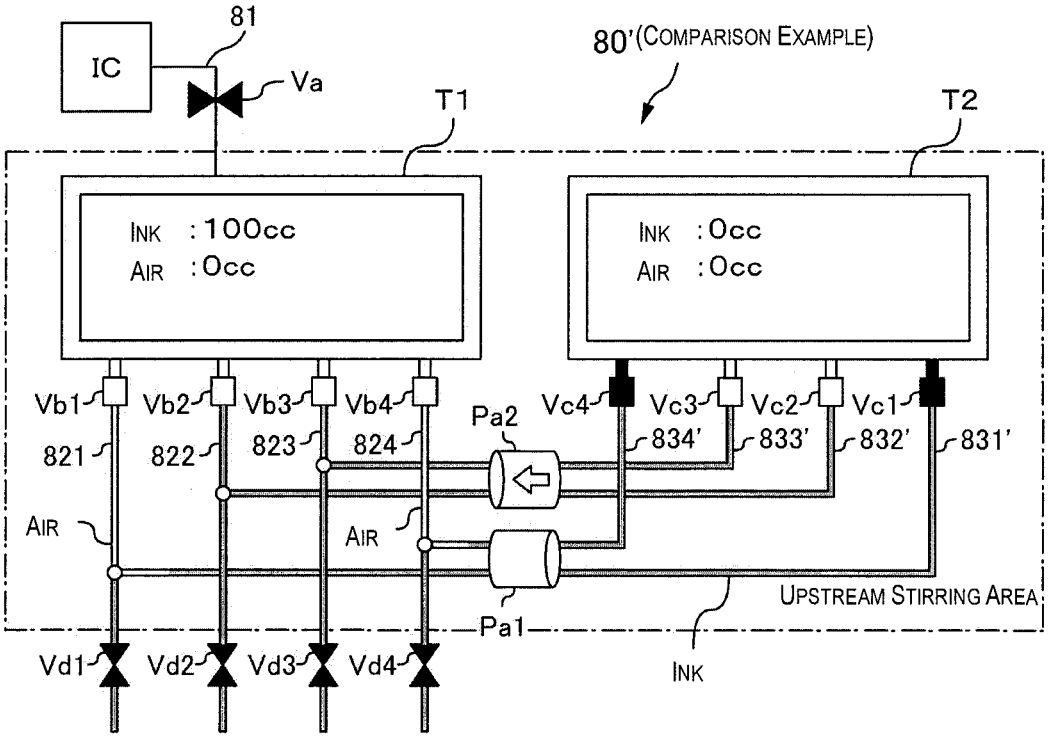
FIG. 5B is an explanatory drawing of the stirring process with the upstream stirring area of a comparison example.

Next, as shown in FIG. 5B, the controller 60 opens the second and third temporary tank valves Vc2 and Vc3, closes the first and fourth temporary tank valves Vc1 and Vc4, and drives only the second upstream pump Pa2 until the temporary tank T2 is in a crushed state. At this time, white ink flows from the temporary tank T2 to the sub tank T1 through the second branch tube 832', the region of the second supply tube 822 between from the connecting point of the second supply tube 822 and the second branch tube 832' to the second sub tank valve Vb2, the third branch tube 833', and the region of the third supply tube 823 between from the connecting part of the third supply tube 823 and the third branch tube 833' to the third sub tank valve Vb3 (hereafter collectively referred to as the "return path"). As a result, the temporary tank T2 is in a hollow state, and the sub tank T1 is filled with the ink filled in the return path (e.g. 10 cc) and the ink that flowed out from the temporary tank T2 (e.g. 90 cc), and the return path is filled with ink (e.g. 10 cc) that finally flowed out from the temporary tank T2.

In this way, by moving the white ink back and forth between the sub tank T1 and the temporary tank T2, the white ink inside the upstream stirring area is stirred, and it is possible to eliminate the white ink coloring material sedimentation. However, air remains in the first and fourth supply tubes 821 and 824. This is because with the upstream stirring area of the comparison example, when the white ink returns from the temporary tank T2 to the sub tank T1, white ink only flows from the second and third branch tubes 832' and 833' to the second and third supply tubes 822 and 823, and white ink does not flow to the first and fourth supply tubes 821 and 824. Because of that, it is not possible to return the air that remained inside the first and fourth supply tubes 821 and 824 when in the outward path (when moving white ink from the sub tank T1 to the temporary tank T2) to the sub tank T1.

When the stirring process ends in this state, and the next operation such as printing or the like is executed, when white ink is replenished from the sub tank T1 to the head group 32, the air inside the first and fourth supply tubes 821 and 824 flows to the head group 32. When air (air bubbles) mix into inside the head 31, it is not possible to discharge the ink properly from the nozzles Nz, and image quality degradation of the printing image occurs. Also, replenishing of the ink is obstructed by the air inside the head 31. Because of that, with the stirring process of the comparison example, the processes shown in FIG. 5C to FIG. 5F have to be further executed.

Figure 5C:
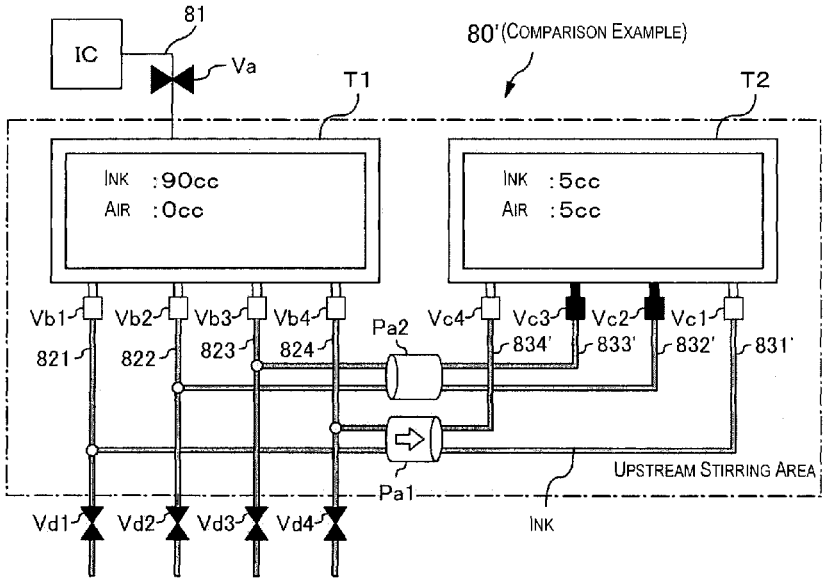
FIG. 5C is an explanatory drawing of the stirring process with the upstream stirring area of a comparison example.

With FIG. 5C, the controller 60 opens the first and fourth temporary tank valves Ve1 and Vc4, closes the second and third temporary tank valves Vc2 and Vc3, and drives only the first upstream pump Pa1. At this time, only a portion (e.g. 10 cc) of the white ink inside the sub tank T1 flows. As a result, the ink (e.g. 5 cc) and air (e.g. 5 cc) filled in the outward path flows into the temporary tank T2, and the outward path is filled with white ink that flows out from the sub tank T1.

Figure 5D:
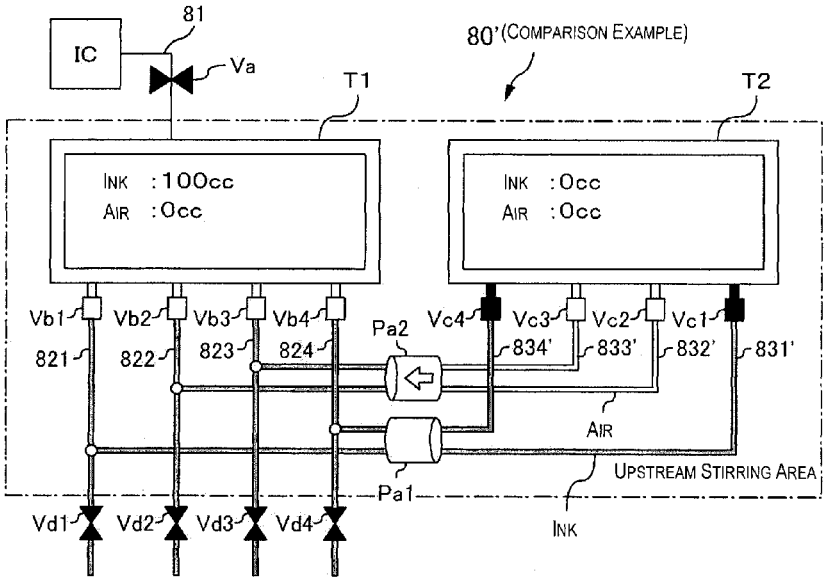
FIG. 5D is an explanatory drawing of the stirring process with the upstream stirring area of a comparison example.

Next, as shown in FIG. 5D, the controller 60 opens the second and third temporary tank valve Vc2 and Vc3, closes the first and fourth temporary tank valves Vc1 and Vc, and drives only the second upstream pump Pa2 until reaching a state with the temporary tank T2 crushed. As a result, the temporary tank T2 is in a hollow state, the ink filled in the return path (e.g. 10 cc) flows to the sub tank T1, and the ink (e.g. 5 cc) and air (e.g. 5 cc) filled in the temporary tank T2 flow to the return path.

Figure 5E:
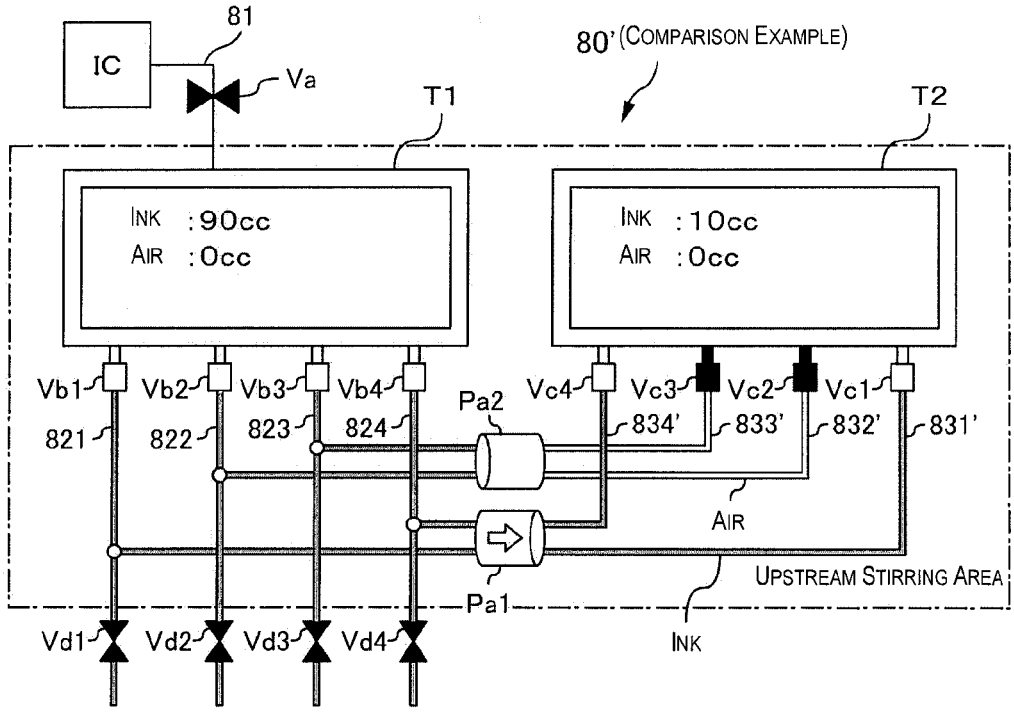
FIG. 5E is an explanatory drawing of the stirring process with the upstream stirring area of a comparison example.

Next, as shown in FIG. 5E, the controller 60 opens the first and fourth temporary tank valves Vc1 and Vc4, closes the second and third temporary tank valves Vc2 and Vc3, drives only the first upstream pump Pa1, and flows a portion of the ink (e.g. 10 cc) of the ink inside the sub tank T1 to the outward path. As a result, the ink filled in the outward path (e.g. 10 cc) flows to the temporary tank T2, and the return path is filled with the ink and air that finally flowed out from the temporary tank T2.

Figure 5F:
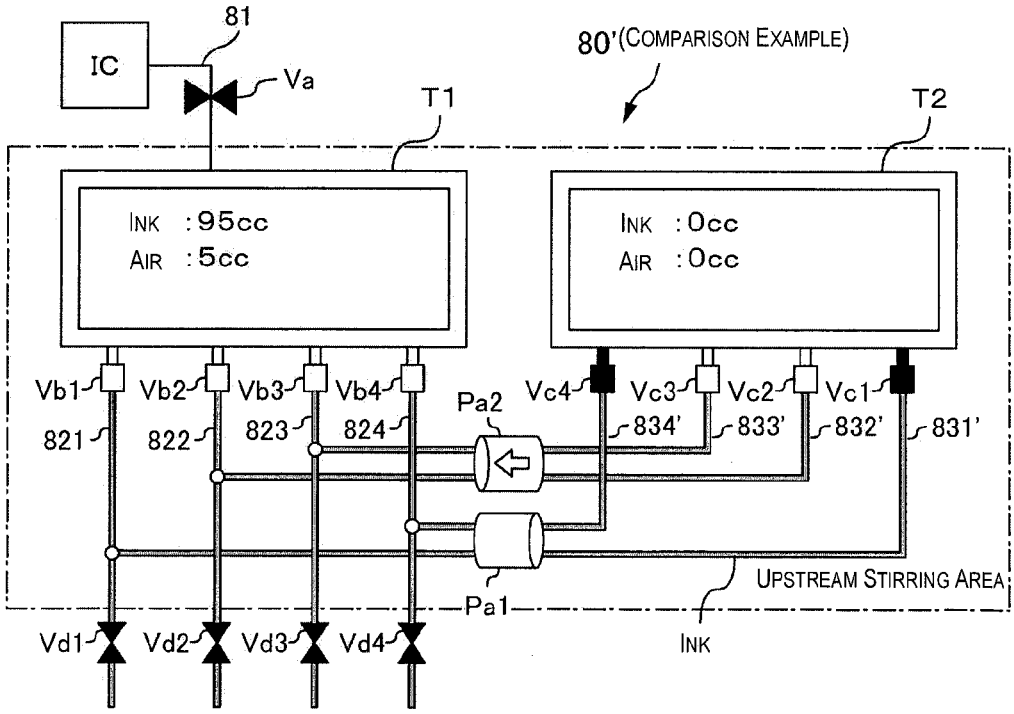
FIG. 5F is an explanatory drawing of the stirring process with the upstream stirring area of a comparison example.

Finally, as shown in FIG. 5F, the controller 60 opens the second and third temporary tank valves Vc2 and Vc3, closes the first and fourth temporary tank valves Vc1 and Vc4, and drives only the second upstream pump Pa2 until the temporary tank T2 is in a crushed state. As a result, this is the same state as before execution of the stirring process (FIG. 5A). Specifically, the ink (5 cc) and air (5 cc) that filled the return path flows to the sub tank T1, the temporary tank T2 is in a hollow state, and the supply tubes 82 and the branch tubes 83 are filled with ink. Therefore, when ink is replenished from the sub tank T1 to the head group 32, it is possible to prevent the air from flowing into the head 31.

In this way, with the upstream stirring area of the comparison example (with the flow path constitution), when the ink is only moved back and forth once between the sub tank T1 and the temporary tank T2 (FIG. 5A and FIG. 5B), air remains inside the supply tube 82, and air mixes into inside the head 31 when white ink is replenished in the head 31.

Meanwhile, by continuing to execute the process of from FIG. 5C to FIG. 5F, specifically, by moving the ink back and forth three times between the sub tank T1 and the temporary tank T2, it is possible to remove the air from the supply tube 82, and possible to prevent air from being mixed into inside the head 31 when replenishing the white ink. However, the stirring process takes time.

Upstream Stirring Area: This Embodiment

Figure 6A:
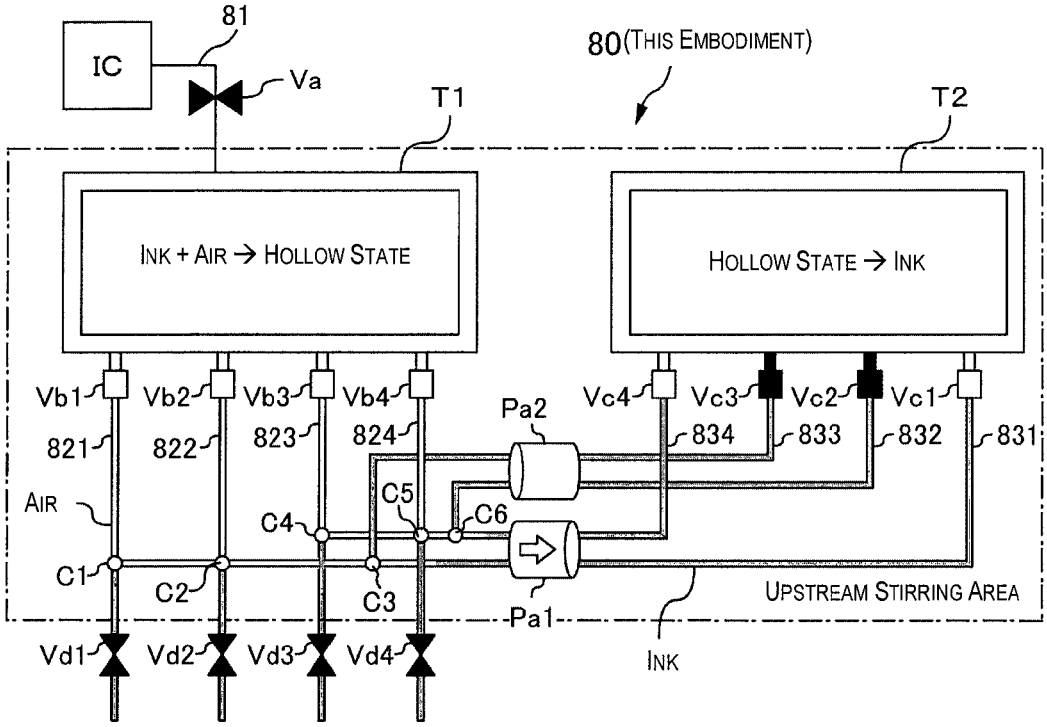
FIG. 6A is an explanatory drawing of the stirring process with the upstream stirring area of this embodiment.
Figure 6B:
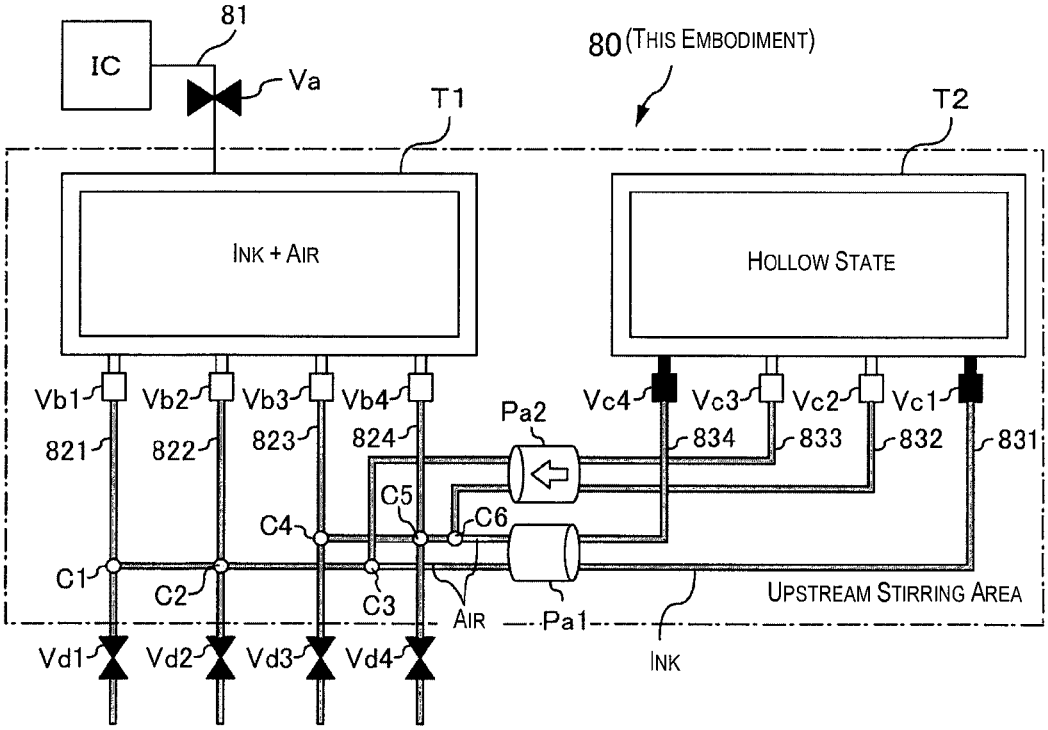
FIG. 6B is an explanatory drawing of the stirring process with the upstream stirring area of this embodiment.

FIG. 6A and FIG. 6B are explanatory drawings of the stirring process in the upstream stirring area of this embodiment. As described previously, with the upstream stirring area of this embodiment, the first upstream pump Pa1 is provided midway in the first and fourth branch tubes 831 and 834, so the first and fourth branch tubes 831 and 834 become the outward path. Meanwhile, the second upstream pump Pa2 is provided midway in the second and third branch tubes 832 and 833, so the second and third branch tubes 832 and 833 become the return.

Then, to the first branch tube 831 which is the outward path, the first supply tube 821 is connected by a first connector C1, the second supply tube 822 is connected by a second connector C2, and the third branch tube 833 which is the return path is connected by a third connector C3. Similarly, to the fourth branch tube 834 which is the outward path, the third supply tube 823 is connected by a fourth connector C4, the fourth supply tube 824 is connected by a fifth connector C5, and the second branch tube 832 which is the return path is connected by a sixth connector C6.

When executing the stirring process on the upstream stirring area which is a flow path constitution like that described above, the controller 60 first closes the cartridge valve Va if it is open, and closes the four intermediate valves Vd1 to Vd4. Having done that, a closed flow path is formed constituted by the upstream tube 81 (one portion), the sub tank T1, the temporary tank T2, the four supply tubes 821 to 824 (one portion), and the four branch tubes 831 to 834. The same as with the comparison example, air (air bubbles) is mixed in together with ink in the sub tank T1, and in a state with neither ink nor air housed in the temporary tank T2 (hollow state), ink is filled in the supply tube 82 and the branch tube 83.

Next, as shown in FIG. 6A, the controller 60, in a state with having closed the second and third temporary tank valves Vc2 and Vc3, and opened the first and fourth temporary tank valves Vc1 and Vc4 and the sub tank valves Vb1 through Vb4, drives only the first upstream pump Pa1 until reaching a state for which the sub tank T1 is crushed. At this time, ink flows from the sub tank T1 to the temporary tank T2 passing through the sites of the supply tubes 821 to 824 between the sub tank valves Vb1 to Vb4 and the connectors C1, C2, C4, and C5, and the first and fourth branch tubes 831 and 834 (hereafter collectively referred to as the "outward path"). As a result, the sub tank T1 goes to a hollow state, the temporary tank T2 is filled with ink filled in the outward path and ink that flowed out from the sub tank T1, and the ink and air that flowed out finally from the sub tank T1 remains in the outward path.

Next, as shown in FIG. 6B, the controller 60 opens the second and third temporary tank valves Vc2 and Vc3, closes the first and fourth temporary tank valves Vc1 and Vc4, and drives only the second upstream pump Pa2 until the temporary tank T2 reaches a crushed state. At this time, the ink that flowed out from the temporary tank T2, after passing through the second and third branch tubes 832 and 833, passes through the first branch tube 831 (site between the third connector C3 and the first connector C1) and the fourth branch tube 834 (site between the sixth connector C6 and fourth connector C4), and finally passes through the four supply tubes 821 to 824 (hereafter referred to as the "return path") and returns to the sub tank T1.

Because of that, the air that flowed out from the sub tank T1 during the outward path time (time when ink moves from the sub tank T1 to the temporary tank T2) to the supply tubes 821 to 824 and to the first and fourth branch tubes 831 and 834 is pushed and flowed to the sub tank T1 together with the ink that flowed out from the temporary tank T2 during the return path time (time when the ink moves from the temporary tank T2 to the sub tank T1). Therefore, as a result of FIG. 6B, the temporary tank T2 goes to a hollow state, the sub tank T1 becomes full with the ink and air filled in the return path, the supply tubes 821 to 824 are filled with ink, and the branch tubes 831 to 834 are almost filled with ink. Specifically, it is possible to remove the air from the supply tubes 821 to 824.

To summarize the above, the upstream stirring area of this embodiment is constituted by supply tubes 821 to 824 (first flow paths) for which one end is connected to the head 31 (head group 32) and the other end is connected to the sub tank T1 (first reservoir unit), the first and fourth branch tubes 831 and 834 (second flow paths) for which one end is connected midway in the supply tubes 821 to 824 and the other end is connected to the temporary tank T2 (second reservoir unit), the second and third branch tubes 832 and 833 (third flow paths) for which one end is connected to the temporary tank T2 and the other end is connected midway in the first and fourth branch tubes 831 and 834, the first upstream pump Pa1 (first pressure supply unit) provided on the first and fourth branch tubes 831 and 834 that moves ink from the sub tank T1 to the temporary tank T2, and the second upstream pump Pa2 (second pressure supply unit) provided on the second and third branch tubes 832 and 833 that move ink from the temporary tank T2 to the sub tank T1.

In other words, the third branch tube 833 that is the return path is connected to the first branch tube 831 that is the outward path at a position further to the temporary tank T2 side (the upstream position when in the return path) than the connecting parts C1 and C2 of the first and second supply tubes 821 and 822 and the first branch tube 831, so the first and second supply tubes 821 and 822 also become return paths. Similarly, the second branch tube 832 that becomes the return path is connected to the fourth branch tube 834 that is the outward path at a position further to the temporary tank T2 side than the connecting parts C4 and C5 of the third and fourth supply tubes 823 that become the outward path and the fourth branch tube 834, so the third and fourth supply tubes 823 and 824 also become return paths.

With that kind of flow path structure, the controller 60 (control unit) moves the white ink back and forth between the sub tank T1 and the temporary tank T2. As a result, the white ink inside the sub tank T1 and the supply tube 82 is stirred, and it is possible to eliminate the white ink coloring material sedimentation. Furthermore, even when the air is flowed out from the sub tank T1 to the supply tube 821 to 824 when in the outward path, it is possible to flow ink when in the return path to the region of the supply tubes 821 to 824 for which air is remaining, and it is possible to return the air inside the supply tubes 821 to 824 to the sub tank T1.

In other words, simply by moving the ink back and forth one time between the sub tank T1 and the temporary tank T2 (FIG. 6A and FIG. 6B), it is possible to remove the air from the supply tube 82. Therefore, it is possible to prevent air from being mixed into the inside of the head 31 when replenishing white ink, and possible to prevent ink discharge failure or obstruction of ink supply. Also, compared to the circulation process of the comparison example which moves the ink back and forth three times (FIG. 5A to FIG. 5F), it is possible to shorten the circulation processing time with this embodiment.

Of the first and fourth branch tubes 831 and 834, it is not possible to flow ink when in the return path to a region further to the temporary tank T2 side than the third and sixth connectors C3 and C6 which is the connecting part of the branch tubes 83 with each other. Because of that, when air is mixed in at that region when in the outward path (FIG. 6A), a portion of the air of the first and fourth branch tubes 831 and 834 remains (FIG. 6B). However, even if air remains in the branch tubes 83, that air does not flow to the head 31 during ink replenishment to the head 31, so a problem does not occur.

Unstirred Area

With the process described above, it is possible to have the white ink inside the upstream stirring area and the downstream stirring area stirred, and to eliminate the white ink coloring material sedimentation. However, of the supply tubes 82, the white ink that exists inside the region further downstream than the head side valve Ve, and inside the head 31 (hereafter collectively referred to as the "unstirred area") is not stirred, the white ink inside the unstirred area is retained for a long time, and the coloring material precipitates. In light of that, the white ink inside the unstirred area after the end of the previously described stirring process (FIG. 4 and FIG. 6) is ejected (discarded). By doing that, the white ink retained for a long time being used for printing and degrading the image quality of the printing image is prevented.

As a method of ejecting the white ink of the unstirred area, an example is the cleaning process of the head 31 shown in FIG. 3. In addition, there is a method of ejecting the white ink of the unstirred area using a flushing operation. With the head 31 cleaning process, ink that is not sedimentary ink (specifically, ink for which problems do not occur when retained) is ejected simultaneously together with the sedimentary ink. In contrast to this, with the flushing operation, it is possible to eject only the sedimentary ink of the unstirred area, and it is possible to inhibit wasteful ink consumption.

For example, we'll assume a constitution whereby the head 31 has, for each nozzle Nz, a pressure chamber in communication with that nozzle Nz and filled with ink, and a drive element that changes the pressure within that pressure chamber. In this case, to eject white ink inside the unstirred area using the flushing operation, it is possible to apply flushing drive signals (discharge waveforms) to the drive element corresponding to the nozzle Nz discharging the white ink. The ink discharge method from the nozzle can be the piezo method by which the pressure chamber expands and contracts when voltage is applied to a piezo element, or can be a thermal method by which air bubbles are generated inside the nozzle using a heating element, and ink is sprayed from the nozzle using those air bubbles.

Summary

As described above, by circulating and stirring the white ink inside the upstream stirring area and the downstream stirring area, it is possible to eliminate the white ink coloring material sedimentation. Therefore, it is possible to use the white ink inside the region further upstream than the head side valve Ve for printing or the like without ejecting it (discarding), so it is possible to prevent white ink from being consumed wastefully.

Also, as described previously, the sub tank T1 and the head group 32 are arranged at separated positions, and the supply tube 82 is long. Because of that, by stirring the white ink divided into the upstream stirring area and the downstream stirring area, it is possible to shorten the stirring process time, and it is possible to use a pump with a small power source. However, the invention is not limited to this, and it is also possible to have the white ink stirred with the flow path between the cartridge valve Va and the head side valve Ve as one closed flow path (circulation flow path).

Also, with the actual printer 1, for example during the period that the power is on, it is possible to execute the stirring process basically every four hours. Specifically, when four hours have elapsed since the previous stirring process during print job processing, it is possible to execute the stirring process during the processing of that print job. By doing that, it is possible to more reliably prevent white ink that was retained for four hours since the previous stirring process (or white ink for which being retained is a concern) from being used for printing. It is also possible to derive the time for which problems will not occur even if the white ink is retained inside the head 31 or the like through testing, for example, in order to set the time from the previous stirring process (four hours).

Meanwhile, in cases when the print job is not being processed when four hours have elapsed since the previous stirring process, it is also possible to execute the stirring process before starting the next operation without executing the stirring process. Also, during the period when the power is off, it is also possible to not execute the stirring process even when four hours have elapsed since the previous stirring process. In a state with the operation such as the print job or the like not executed, the problem does not occur even when white ink is retained, so it is possible to reduce wasteful stirring processing, and it is possible to inhibit ink consumption due to ejecting of white ink in the unstirred area.

Modification Example

Upstream Stirring Area

Figure 7:
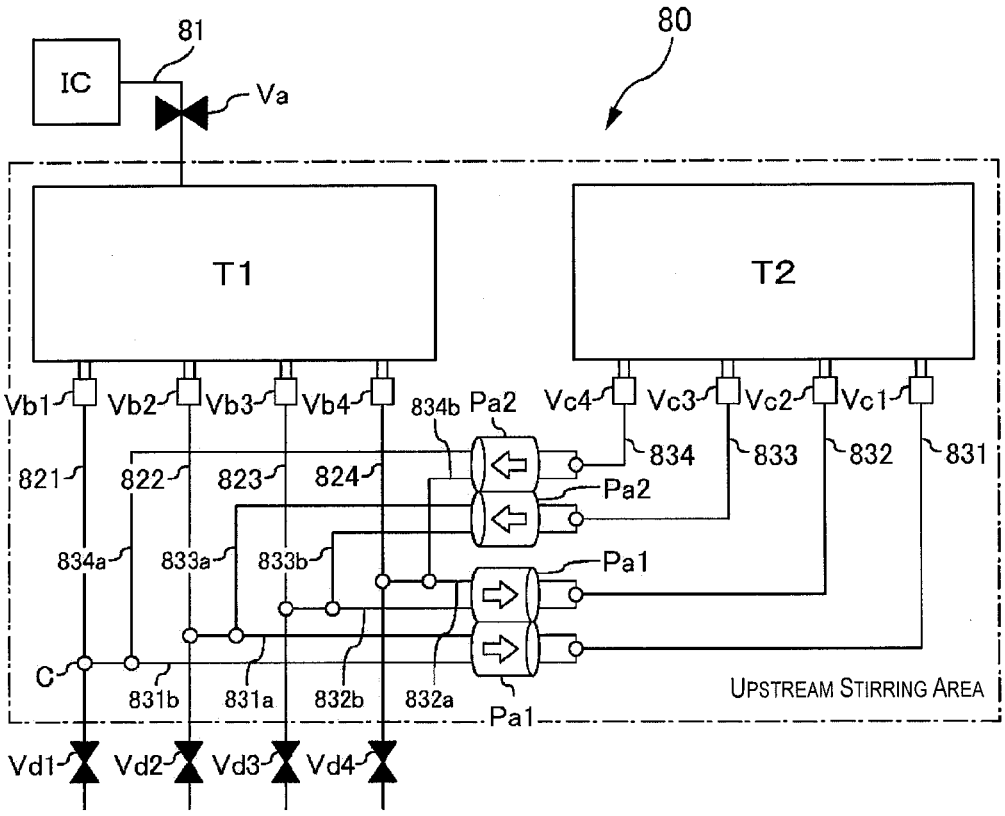
FIG. 7 is a drawing showing a modification example of the upstream stirring area.
Figure 8:
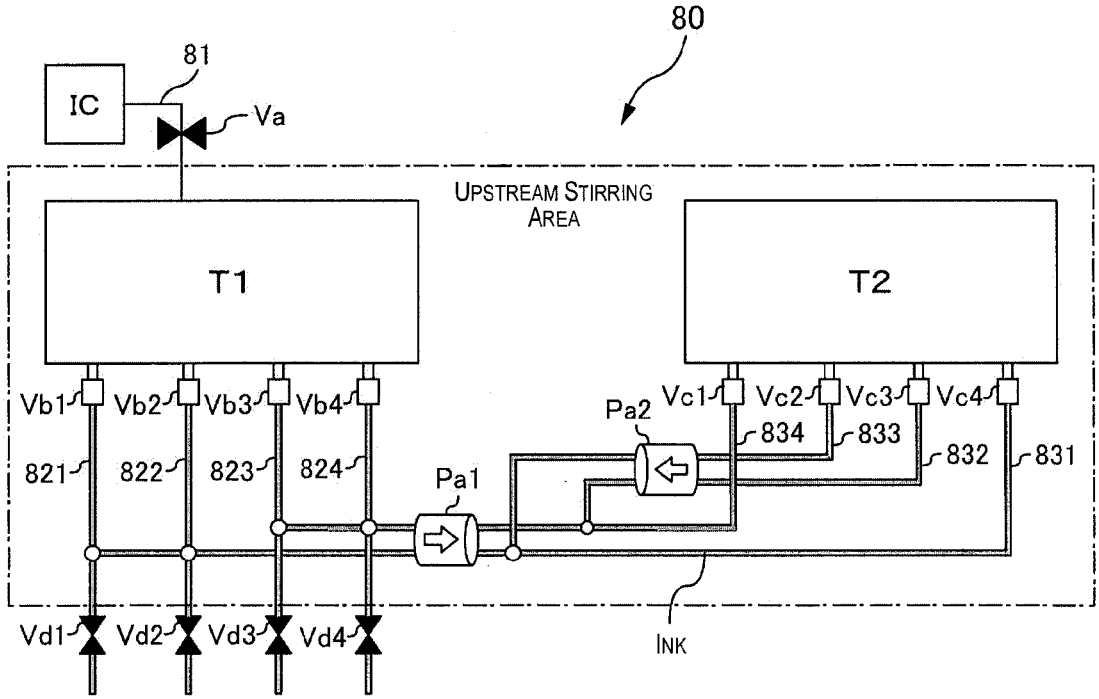
FIG. 8 is a drawing showing a modification example of the upstream stirring area.

FIG. 7 and FIG. 8 are drawings showing modification examples of the upstream stirring area. With the upstream stirring area shown in FIG. 4, one each of the first upstream pump Pa1 and the second upstream pump Pa2 are respectively provided, but the invention is not limited to this. For example, it is also possible to respectively provide a plurality of the first upstream pump Pa1 and the second upstream pump Pa2 (in FIG. 7, two each), and it is also possible to provide a plurality of only one of these. In other words, it is possible to have at least one of the first pressure supply unit that feeds ink in the direction of moving ink from the sub tank T1 to the temporary tank T2 and the second pressure supply unit that feeds ink in the direction of moving the ink form the temporary tank T2 to the sub tank T1 have a plurality of pumps. By doing that, it is possible to further shorten the stirring process time.

However, compared to when there is a small number of pumps, the flow path constitution becomes complex (there is a larger number of tubes). In specific terms, as shown in FIG. 7, the tube 831*b* branched from the first supply tube 821 and the tube 831*a* branched from the second supply tube 822 are connected to one first upstream pump Pa1, and those two branch tubes 831*a* and 831*b* become one tube 831 and are connected to the temporary tank T2. Similarly, the tube 832*b* branched from the third supply tube 823 and the tube 832*a* branched from the fourth supply tube 824 are connected to the other first upstream pump Pa1, those two branch tubes 832*a* and 832*b* become one tube 832 and are connected to the temporary tank T2. These become the outward path.

Then, the tube 833 connected to the temporary tank T2 is branched into two tubes 833*a* and 833*b* which are connected to one second upstream pump Pa2, and similarly, the tube 834 connected to the temporary tank T2 is branched into two tubes 834*a* and 834*b* which are connected to the other second upstream pump Pa2. Then, four tubes 833*a*, 833*b*, 834*a*, and 834*b* connected to the second upstream pump Pa2 are respectively connected to the tube 831*a*, 831*b*, 832*a*, and 832*b* branched from the supply tubes 821 to 824. Because of that, the air remaining in the supply tubes 821 to 824 when in the outward path can be returned to the sub tank T1 with the ink that flows when in the return path, and it is possible to inhibit air from mixing in to inside the head during ink replenishment.

Also, with the upstream stirring area shown in FIG. 4, the second and third branch tubes 832 and 833 are connected to the first and fourth branch tubes 831 and 834 further to the sub tank T1 side than the first upstream pump Pa1, but the invention is not limited to this. When the constitution is such that the flow path is not blocked even when driving of the first upstream pump Pa1 is stopped, as shown in FIG. 8, the second and third branch tubes 832 and 833 can also be connected to the first and fourth branch tubes 831 and 834 further to the temporary tank T2 side than the first upstream pump Pa1. By doing that, when in the return path, it is possible to have ink flow from further upstream (temporary tank T2 side) of the first and fourth branch tubes 831 and 834. Therefore, the air does not remain easily in the first and fourth branch tubes 831 and 834. Said another way, it is possible to have air remain at a more distant position from the supply tubes 82 and the branch tubes 83. Because of that, it is possible to better inhibit mixing in of air to inside the head 31 during ink replenishment.

Maintenance Fluid Filling

For example, when the power is off or during a print job that does not use white ink, it is also possible to remove the white ink from the unstirred area, and to fill the unstirred area instead with maintenance fluid or clear ink. Maintenance fluid and clear ink are inks for which components do not precipitate even with long term retention. Because of that, with the ink replenishment unit 80 (FIG. 4), it is sufficient to have the constitution such that a tube that supplies maintenance fluid or the like is connected to the region of the supply tube 82 further downstream than the head side valve Ve. Then, in a state with the cap 71 (FIG. 3) adhered to the head 31, the head side valve Ve is closed, and in a state for which maintenance fluid or the like can be supplied, the suction pump 73 is driven. By doing that, the white ink of the unstirred area is suctioned, and instead, maintenance fluid or the like is filled in the unstirred area. The reverse process is executed when use of the white ink is started again. By doing that, it is possible to prevent the nozzles Nz from becoming clogged by the white ink hardening due to leaving the white ink standing for a long time. Also, even if the head 31 cleaning process (FIG. 3) is executed during a print job which does not use white ink, if the unstirred area is filled with maintenance fluid or the like, maintenance fluid or the like is suctioned instead of white ink, so it is possible to inhibit consumption of relatively expensive white ink.

Printer

Figure 9:
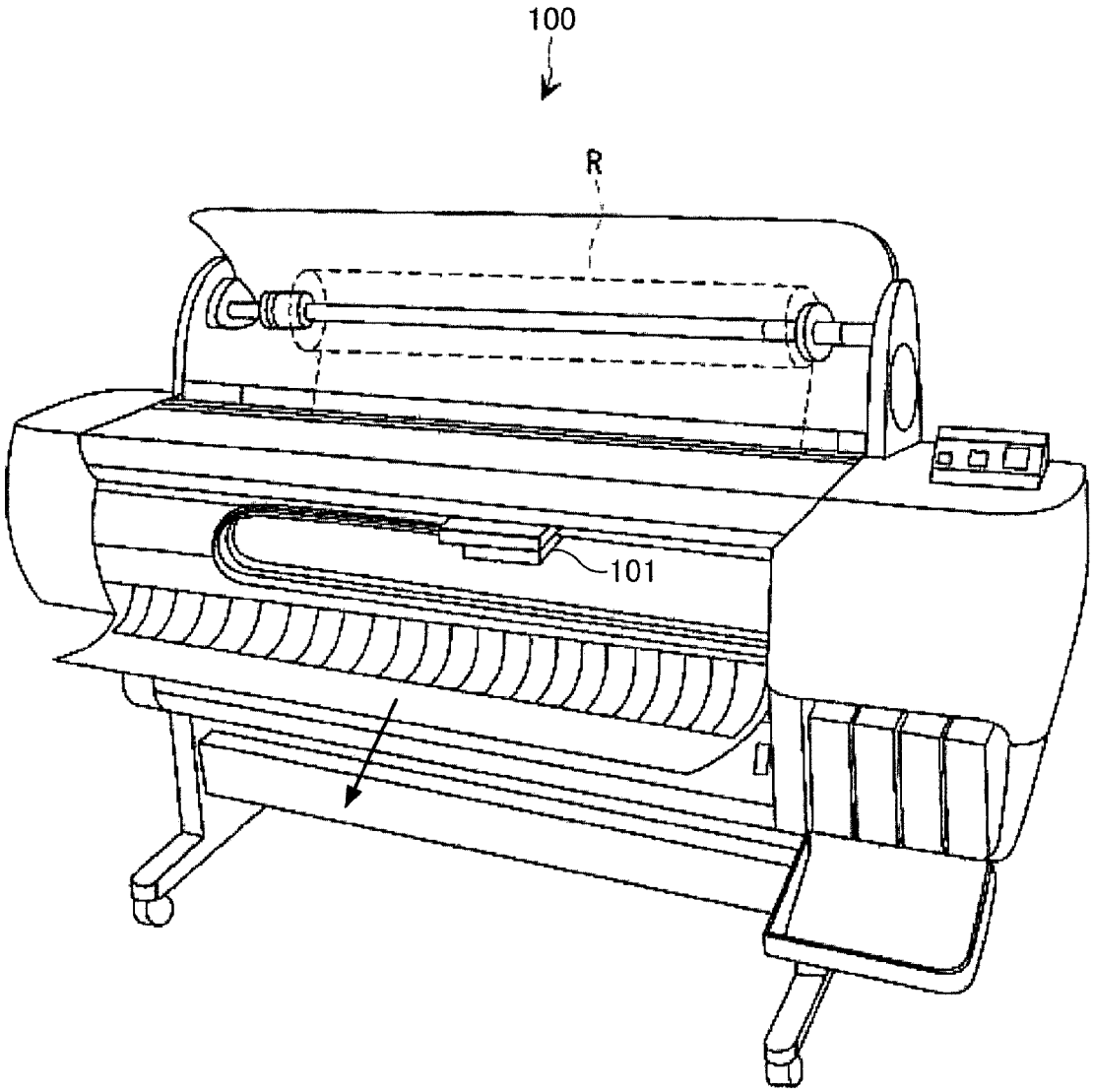
FIG. 9 is an explanatory drawing of the printer of a modification example.

FIG. 9 is an explanatory drawing of the printer 100 of a modification example. With the embodiment noted above (FIG. 1), an example of the printer 1 is shown for which, in relation to the region of the roll paper S conveyed to the printing area A, the operation of printing an image by having the head group 32 discharge ink while moving in the X direction (roll paper S conveyance direction) and having the head group 32 move in the Y direction (paper width direction), and the operation of conveying a new region of the roll paper S to the printing area A were repeated, but the invention is not limited to this. For example, as shown in FIG. 9, it is also possible to have the printer 100 that prints two dimensional images on roll paper R by repeating the operation of discharging ink while moving the head group 101 in the paper width direction of the roll paper R and the operation of conveying the roll paper R in the conveyance direction. Also, for example, it is possible to have a printer for which the head discharges ink toward the roll paper when the bottom of the head for which nozzles are aligned and fixed across a length of the paper width or greater of the roll paper passes through in the direction for which the roll paper is orthogonal to the paper width direction.

Sedimentary Ink

With the embodiment noted above, white ink was given as an example of sedimentary ink, but the invention is not limited to this. The sedimentary ink is acceptable as long as it is an ink such that when it is retained for a long time, the ink components precipitate, and examples include pigmented inks containing large particle pigments or heavy pigments, metallic inks containing metal pigments such as aluminum, silver or the like (ink that expresses a metallic sheen on the printed material), and the like.

Above, the embodiments noted above are items to make the present invention easy to understand, and are not to be interpreted as restricting the present invention. It goes without saying that the present invention can be modified and improved, and the equivalent items of the present invention are included therein without straying from its gist. For example, with the embodiment noted above, an embodiment with a printer 1 alone is shown as the printing device, but the invention is not limited to this, and it is also possible to have the printing device be a part of a compound apparatus such as a fax or scanner device, a copy device or the like.

General Interpretation of Terms

In understanding the scope of the present invention, the term "comprising" and its derivatives, as used herein, are intended to be open ended terms that specify the presence of the stated features, elements, components, groups, integers, and/or steps, but do not exclude the presence of other unstated features, elements, components, groups, integers and/or steps. The foregoing also applies to words having similar meanings such as the terms, "including", "having" and their derivatives. Also, the terms "part," "section," "portion," "member" or "element" when used in the singular can have the dual meaning of a single part or a plurality of parts. Finally, terms of degree such as "substantially", "about" and "approximately" as used herein mean a reasonable amount of deviation of the modified term such that the end result is not significantly changed. For example, these terms can be construed as including a deviation of at least ±5% of the modified term if this deviation would not negate the meaning of the word it modifies.

While only selected embodiments have been chosen to illustrate the present invention, it will be apparent to those skilled in the art from this disclosure that various changes and modifications can be made herein without departing from the scope of the invention as defined in the appended claims. Furthermore, the foregoing descriptions of the embodiments according to the present invention are provided for illustration only, and not for the purpose of limiting the invention as defined by the appended claims and their equivalents.

What is claimed is:

1. A printing device comprising:

a head configured and arranged to discharge sedimentary ink;

a first reservoir unit configured and arranged store the sedimentary ink;

a second reservoir unit configured and arranged to store the sedimentary ink from the first reservoir unit;

a first flow path for which one end is connected to the head, and the other end is connected to the first reservoir unit;

a second flow path for which one end is connected to the first flow path, and the other end is connected to the second reservoir unit;

a third flow path for which one end is connected to the second reservoir unit, and the other end is connected to the second flow path;

a first pressure supply unit provided on the second flow path, and configured and arranged to send the sedimentary ink in a direction for which the sedimentary ink is moved from the first reservoir unit to the second reservoir unit;

a second pressure supply unit provided on the third flow path, and configured and arranged to send the sedimentary ink in a direction for which the sedimentary ink is moved from the second reservoir unit to the first reservoir unit; and a control unit configured to execute a stirring process of stirring the sedimentary ink by returning the sedimentary ink inside the second reservoir unit to the first reservoir unit using the second pressure supply unit after the sedimentary ink inside the first reservoir unit is moved to the second reservoir unit using the first pressure supply unit.

2. The printing device according to claim 1, wherein at least one of the first pressure supply unit and the second pressure supply unit has a plurality of pumps.

3. A printing device maintenance method for a printing device including a head configured and arranged to discharge sedimentary ink, a first reservoir unit configured and arranged to store the sedimentary ink, a second reservoir unit configured and arranged to store the sedimentary ink from the first reservoir unit, a first flow path for which one end is connected to the head and the other end is connected to the first reservoir unit, a second flow path for which one end is connected to the first flow path and the other end is connected to the second reservoir unit, and a third flow path for which one end is connected to the second reservoir unit and the other end is connected to the second flow path, the printing device maintenance method comprising:

moving the sedimentary ink inside the first reservoir unit to the second reservoir unit using a first pressure supply unit provided in the second flow path; and using a second pressure supply unit provided in the third flow path, returning the sedimentary ink inside the second reservoir unit moved from the first reservoir unit to the first reservoir unit, and stirring the sedimentary ink.

* * * * *